US010997905B2

(12) United States Patent
Tong et al.

(10) Patent No.: US 10,997,905 B2
(45) Date of Patent: May 4, 2021

(54) DISPLAY PANEL AND DISPLAY DEVICE

(71) Applicants: Chengdu BOE Optoelectronics Technology Co., Ltd., Chengdu (CN); BOE Technology Group Co., Ltd., Beijing (CN)

(72) Inventors: Zhenxiao Tong, Beijing (CN); Weiyun Huang, Beijing (CN); Xiangdan Dong, Beijing (CN); Tingliang Liu, Beijing (CN); Yunsheng Xiao, Beijing (CN)

(73) Assignees: Chengdu BOE Optoelectronics Technology Co., Ltd., Chengdu (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/621,763

(22) PCT Filed: May 20, 2019

(86) PCT No.: PCT/CN2019/087656

§ 371 (c)(1),
(2) Date: Dec. 12, 2019

(87) PCT Pub. No.: WO2020/024664

PCT Pub. Date: Feb. 6, 2020

(65) Prior Publication Data

US 2021/0027704 A1 Jan. 28, 2021

(30) Foreign Application Priority Data

Jul. 30, 2018 (CN) ..... 201810852874.8

(51) Int. Cl.
*G09G 3/3225* (2016.01)
*G09G 3/3266* (2016.01)

(52) U.S. Cl.
CPC ..... *G09G 3/3225* (2013.01); *G09G 3/3266* (2013.01); *G09G 2320/0233* (2013.01)

(58) Field of Classification Search
CPC ..... G09G 3/3674; G09G 2320/0223; G09G 2320/0233
See application file for complete search history.

(56) References Cited

U.S. PATENT DOCUMENTS 6,879,367 B2 * 4/2005 Ukita ..... G02F 1/1345 349/149
2011/0102384 A1 * 5/2011 Huang ..... G09G 3/3685 345/204
2015/0219945 A1 * 8/2015 Kimura ..... G09G 3/36 349/152

(Continued)

FOREIGN PATENT DOCUMENTS

CN 103745694 A 4/2014
CN 106448587 A 2/2017

(Continued)

*Primary Examiner* — Sepehr Azari
(74) *Attorney, Agent, or Firm* — Michael Fainberg; Arent Fox LLP

(57) ABSTRACT

The present disclosure discloses a display panel and a display device. At least one load compensation unit is arranged in a non-display area, and the at least one load compensation unit can be configured to adjust the charging time of pixels by controlling gate lines, thereby making brightness of each area of the display screen uniform.

16 Claims, 8 Drawing Sheets

(56) References Cited

U.S. PATENT DOCUMENTS

| | | | | |
|---|---|---|---|---|
| 2016/0247470 | A1 | 8/2016 | Tan | |
| 2018/0166018 | A1* | 6/2018 | Yang | G09G 3/3225 |
| 2018/0342194 | A1 | 11/2018 | Li et al. | |

FOREIGN PATENT DOCUMENTS

| | | | |
|---|---|---|---|
| CN | 106991990 | A | 7/2017 |
| CN | 107068047 | A | 8/2017 |
| CN | 107221536 | A | 9/2017 |
| CN | 107610636 | A | 1/2018 |
| CN | 108269516 | A | 7/2018 |

* cited by examiner

DISPLAY PANEL AND DISPLAY DEVICE

This application is a US National Stage of International Application No. PCT/CN2019/087656, filed May 20, 2019, which claims priority to Chinese Patent Application No. 201810852874.8, filed to the Chinese Patent Office on Jul. 30, 2018 and entitled "DISPLAY PANEL AND DISPLAY DEVICE", which is incorporated herein by reference in its entirety.

FIELD

The present disclosure relates to the technical field of display, and in particular to a display panel and a display device.

BACKGROUND

An organic light-emitting diode (OLED) has advantages of being self-luminous, wide in color gamut, high contrast, thin and light, and has been widely used in display devices. As shown in FIG. 1, an OLED display panel may include: a display area AA, pixel units PX located in the display area AA, a high-level voltage supply wire 110 electrically connected to a pixel circuit in each pixel unit PX, and a high-level voltage supply terminal 120 electrically connected to the high-level voltage supply wire 110. The high-level voltage supply terminal 120 is configured to electrically connect to an external power management chip, to input a power supply signal ELVDD into the display area AA. Since the high-level voltage supply wire 110 has a resistance so that in the direction of the high-level voltage supply terminal 120 pointed to the high-level voltage supply wire 110, the voltage of the power supply signal ELVDD is sequentially decreased, that is, the IR Drop phenomenon. Thus, the brightness of the display area AA gradually decreases in the direction of the high-level voltage supply terminal 120 to the high-level voltage supply wire 110, resulting in deterioration of brightness uniformity, thereby affecting the display effect.

SUMMARY

Embodiments of the present disclosure provide a display panel and a display device, and the specific solutions are as follows.

The embodiments of the present disclosure provide a display panel. The display panel includes: a gate driving circuit, wherein the gate driving circuit includes a plurality of output terminals, and at least one of the plurality of output terminals is electrically connected to at least one of the plurality of gate lines; and at least one load compensation unit, between the at least one output terminal and the at least one gate line, and electrically connected with the at least one gate line and the at least one output terminal. The display panel includes a display area and a non-display area surrounding the display area, the plurality of gate lines are in the display area, and the gate driving circuit and the at least one load compensation unit are in the non-display area; and the at least one load compensation unit is configured to adjust charging time of pixels by controlling the gate lines, to make brightness of each area of the display screen uniform.

Optionally in the embodiments of the present disclosure, each output terminal of the gate driving circuit is respectively connected to one of the plurality of gate lines, and different output terminals are connected to different gate lines.

Optionally in the embodiments of the present disclosure, the display panel further includes first voltage supply wires and a first voltage supply terminal; the first voltage supply wires are in the display area, and the first voltage supply terminal is in the non-display area and is electrically connected to the first voltage supply wires; the first voltage supply wires and the plurality of gate lines are cross, all the load compensation units are sequentially divided into at least two unit groups along a direction of the first voltage supply wires away from the first voltage supply terminal, and each of the unit groups has at least one load compensation unit; and the farther the unit group is away from the first voltage supply terminal, the larger the compensation load value of the load compensation unit in the unit group is.

Optionally in the embodiments of the present disclosure, each unit group includes at least two adjacent load compensation units.

Optionally in the embodiments of the present disclosure, compensation load values of the load compensation units in a same unit group are the same, and compensation load values in different unit groups are different.

Optionally in the embodiments of the present disclosure, a quantity of the load compensation units in each unit group is the same.

Optionally in the embodiments of the present disclosure, each unit group includes one load compensation unit.

Optionally in the embodiments of the present disclosure, the load compensation unit includes at least one of a compensation resistor and a compensation capacitor; wherein the output terminal of the gate driving circuit is electrically connected to the corresponding gate line through the compensation resistor; and one terminal of the compensation capacitor is electrically connected to the output terminal of the gate driving circuit and the other terminal of the compensation capacitor is electrically connected to a ground terminal. When the load compensation unit includes the compensation resistor, a resistance value of the compensation resistor acts as the compensation load value of the load compensation unit; when the load compensation unit includes the compensation capacitor, a capacitance value of the compensation capacitor acts as the compensation load value of the load compensation unit; and when the load compensation unit includes the compensation resistor and the compensation capacitor, a product of the resistance value of the compensation resistor and the capacitance value of the compensation capacitor acts as the compensation load value of the load compensation unit.

Optionally in the embodiments of the present disclosure, the compensation resistor includes: a resistor wire with folding line-shape; wherein one end of the resistor wire is electrically connected to the output terminal of the gate driving circuit, and the other end of the resistor wire is electrically connected to the gate line.

Optionally in the embodiments of the present disclosure, the resistor wire includes: a plurality of first resistor wires extending in a first direction and a plurality of second resistor wires extending in a second direction, and the first resistor wires are successively electrically connected to the second resistor wires; and the first direction intersects with the second direction.

Optionally in the embodiments of the present disclosure, a cross-sectional area of at least one of the first resistor wires and the second resistor wires is smaller than a cross-sectional area of the gate lines.

Optionally, in the embodiments of the present disclosure, the display panel further includes: a first conductive layer corresponding to each of the resistor wires and disposed in a different-layer and insulated from the resistor wire; wherein an orthographic projection of the first conductive layer on the display panel has an overlap region with an orthographic projection of the corresponding resistor wire on the display panel; and the compensation capacitor includes: a first capacitor between the first conductive layer and the resistor wire in the overlap region.

Optionally in the embodiments of the present disclosure, the orthographic projection of the first conductive layer on the display panel covers the orthographic projection of the corresponding resistor wire on the display panel.

Optionally in the embodiments of the present disclosure, the display panel further includes: a second conductive layer connected between the first resistor wires and the second resistor wires; wherein the orthographic projection of the first conductive layer on the display panel covers an orthographic projection of the second conductive layer on the display panel; and the compensation capacitor further includes: a second capacitor between the first conductive layer and the second conductive layer.

Optionally in the embodiments of the present disclosure, the display panel further includes: a third conductive layer corresponding to the output terminal that is provided with the load compensation unit, and a fourth conductive layer electrically connected to the output terminal of a shift register unit that is provided with the load compensation unit; wherein the third conductive layer and the fourth conductive layer are arranged in a different-layer and insulated from each other; an orthographic projection of the third conductive layer on the display panel has an overlap region with an orthographic projection of the fourth conductive layer on the display panel; and the compensation capacitor includes: a third capacitor between the fourth conductive layer and the third conductive layer in the overlap region.

Optionally in the embodiments of the present disclosure, the orthographic projection of the third conductive layer on the display panel covers the orthographic projection of the fourth conductive layer on the display panel.

Accordingly, the embodiments of the present disclosure further provide a display device, including the display panel according to the embodiments of the present disclosure.

DETAILED DESCRIPTION

Figure 1:
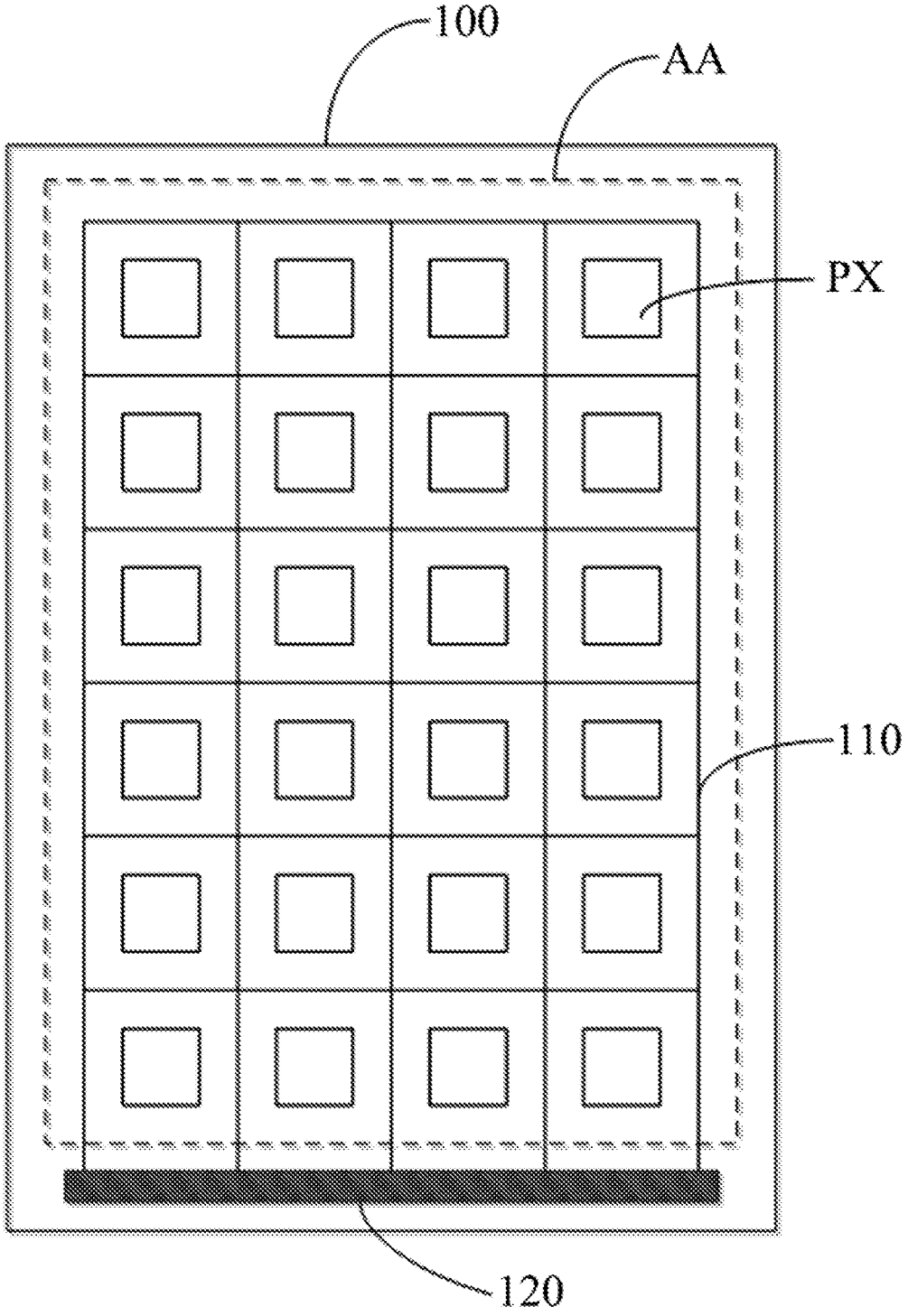
FIG. 1 is a schematic structural diagram of a display panel in the prior art.

To make the objects, technical solutions, and advantages of the present disclosure clearer, the following describes the display panel and the display device according to the present disclosure in detail with reference to the accompanying drawings. It should be understood that the preferable embodiments described in the following are merely used to illustrate and explain the present disclosure, but are not intended to limit the present disclosure. And on the premise of no conflict, the embodiments in this application and features of the embodiments may be mutually combined. In addition, the thickness and shape of the various film layers in the drawings do not reflect the true scale of the display panel and the display device, and are merely intended to indicate and illustrate the disclosure.

Figure 2:
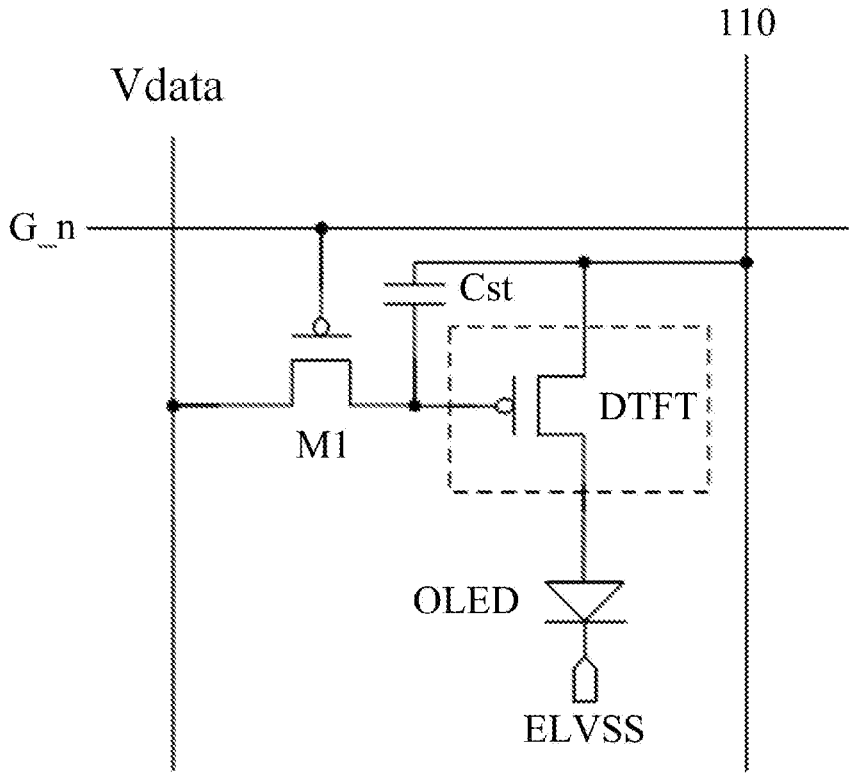
FIG. 2 is a schematic structural diagram of a pixel circuit in the related art.
Figure 3:
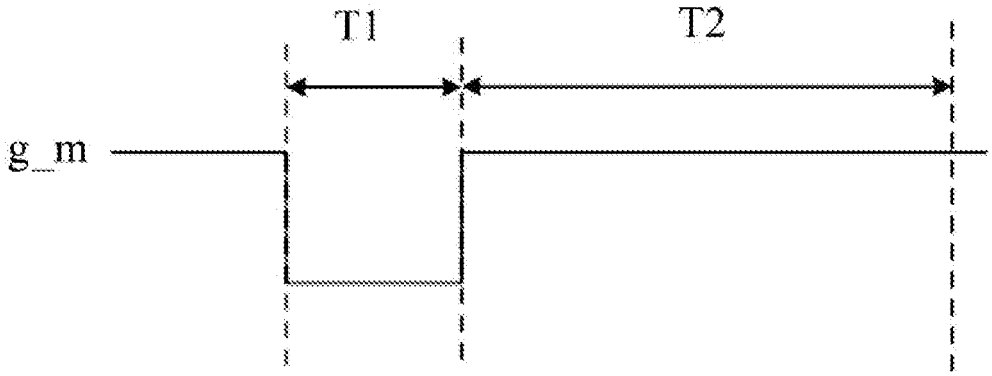
FIG. 3 is a driving timing diagram of the pixel circuit shown in FIG. 2.

Generally, a pixel unit is provided with an OLED and a pixel circuit for driving the OLED to emit light. As shown in FIG. 2, the pixel circuit may include: a driving transistor DTFT, a switching transistor M1, and a storage capacitor Cst. The gate of the switching transistor M1 is connected to a gate line G_m, the source of the switching transistor M1 is connected to a data line (data), and the drain of the switching transistor M1 is connected to a gate of the driving transistor DTFT. The source of the driving transistor DTFT is connected to a first voltage supply wire 110, the drain of the driving transistor DTFT is connected to the anode of the OLED, and the cathode of the OLED is connected to a low voltage power supply wire ELVSS. FIG. 3 shows the driving timing diagram of the pixel circuit in FIG. 2, in the T1 stage, when a signal g_m of the gate line G_m is a gate turn-on signal (ie, a low-level signal), the switching transistor M1 is controlled to be turned on, to supply the data signal of the data line (Data) to the gate of the driving transistor DTFT, and the gate voltage of the driving transistor DTFT is voltage $V_{data}$ of the data signal and is stored by the storage capacitor Cst. In the T2 stage, when the signal g_m of the gate line G_m is a gate turn-off signal (ie, a high-level signal), the switching transistor M1 is controlled to be turned off, the gate voltage of the driving transistor DTFT is $V_{data}$, the source voltage of the driving transistor DTFT is voltage $V_{dd}$ of the power supply signal ELVDD, so that the driving transistor DTFT generates operating current I $I=K(V_{dd}-V_{data}-|V_{th}|)^2$, wherein $|V_{th}|$ represents a threshold voltage of the driving transistor DTFT, and K is a structural parameter, which is relatively stable in a same structure and can be counted as a constant. Due to the influence of IR Drop, when $V_{dd}$ decreases by $\Delta V_{dd}$, $\Delta V_{dd}$ represents the amount of change of $V_{dd}$, I decreases, causing a decrease in luminance, and reduction in display uniformity. In order to improve the display uniformity, $V_{data}$ can be decreased by $\Delta V_{data}$ by adjusting $V_{data}$, the voltage difference of $V_{dd}-V_{data}$ remains stable by making $\Delta V_{data}=\Delta V_{dd}$, thereby avoiding I from being lowered, so as to improve brightness uniformity.

Generally, if the duration of the gate turn-on signal is lowered, the $V_{data}$ charged to the gate of the driving transistor DTFT is lowered. Based on this, the embodiments of the present disclosure provide a display panel that sequentially reduces a gate turn-on signal in a direction from a first row of pixel units to a last row of pixel units, thereby reducing the $V_{data}$ charged to the gate of the driving transistor DTFT, so that the corresponding $\Delta V_{data}$ in the pixel unit can be consistent with the corresponding $\Delta V_{dd}$, thereby maintaining I stable and improving the brightness uniformity.

Figure 4A:
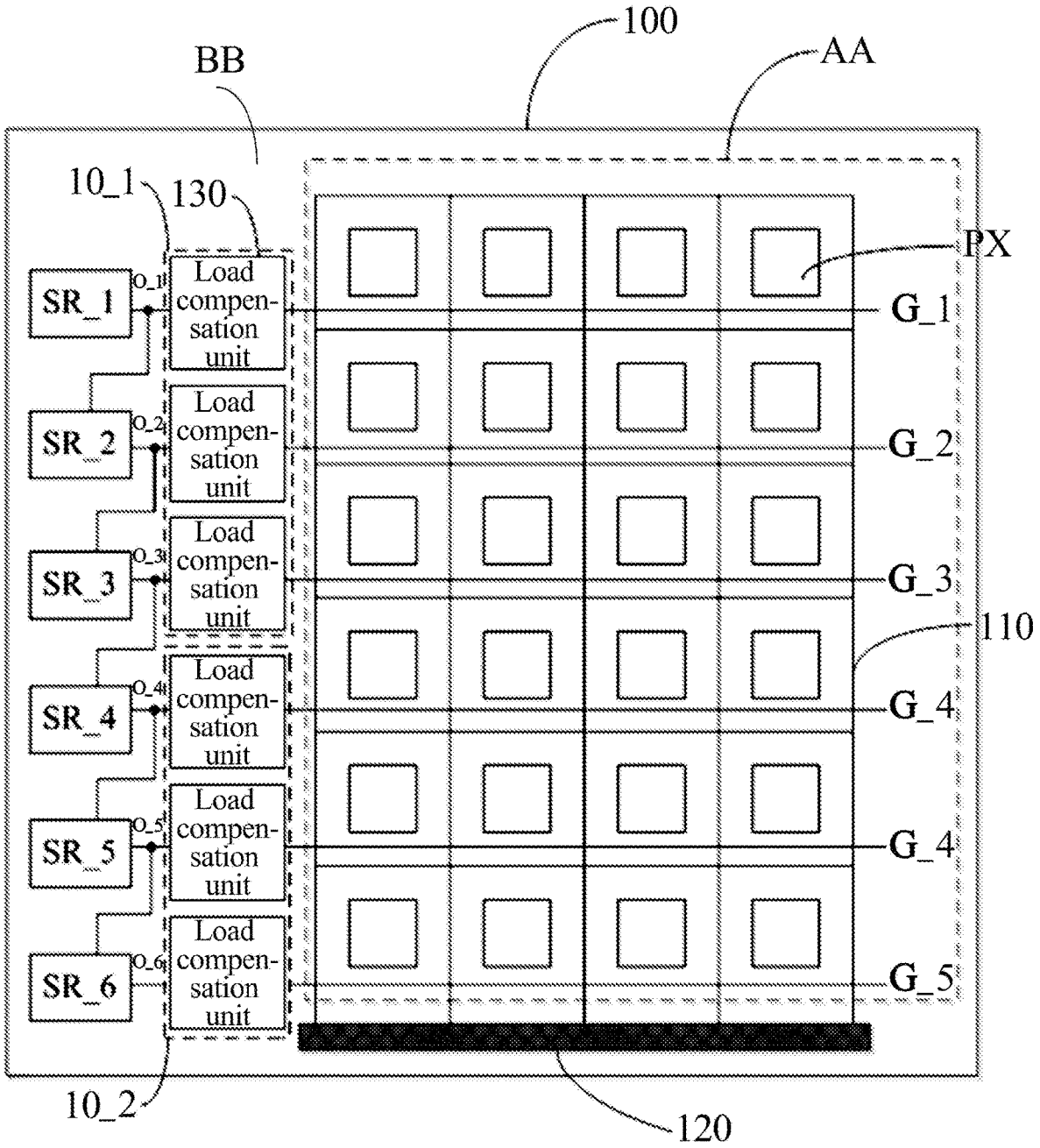
FIG. 4*a* is a first schematic structural diagram of a display panel according to an embodiment of the present disclosure.

As shown in FIG. 4*a*, the display panel according to the embodiments of the present disclosure may include: a plurality of gate lines G_m (wherein $1 \leq m \leq M$, m is an integer, and M is a total quantity of gate lines, and FIG. 2 takes M=6 as an example); a gate driving circuit, where the gate driving circuit includes a plurality of output terminals O_m, and at least one of the plurality of output terminals O_m is electrically connected to at least one of the plurality of gate lines G_m; and at least one load compensation unit 130, located between the at least one output terminal O_m and the at least one gate line G_m, and electrically connected with the at least one gate line G_m and the at least one output terminal O_m.

The display panel includes a display area AA and a non-display area BB surrounding the display area AA, the plurality of gate lines G_m are located in the display area AA, and the gate driving circuit and the at least one load compensation unit 130 are located in the non-display area BB. The at least one load compensation unit 130 is configured to adjust the charging time of pixels by controlling the gate lines G_m, to make brightness of each area of the display screen uniform.

In the display panel according to the embodiments of the present disclosure, at least one load compensation unit is arranged in the non-display area, and can be configured to adjust the charging time of pixels by controlling the gate lines, thereby making brightness of a plurality of areas of the display screen uniform.

Optionally, in the display panel according to the embodiments of the present disclosure, as shown in FIG. 4*a*, each output terminal O_m of the gate driving circuit is respectively connected to one of the plurality of gate lines G_m, and different output terminals O_m are connected to different gate lines G_m.

Optionally, the display panel according to the embodiments of the present disclosure, as shown in FIG. 4*a*, further includes first voltage supply wires 110 and a first voltage supply terminal 120.

The first voltage supply wires 110 are located in the display area AA, and the first voltage supply terminal 120 is located in the non-display area BB and is electrically connected to the first voltage supply wires 110.

The first voltage supply wires 110 and the plurality of gate lines G_m are cross arranged. All load compensation units 130 are sequentially divided into at least two unit groups 10_*n* (where $1 \leq n \leq N$, n is an integer, and N is a total quantity of unit groups, and FIG. 2 takes N=2 as an example) along a direction of the first voltage supply wire 110 away from the first voltage supply terminal 110, and each of the unit groups 10_*n* has at least one load compensation unit 130; and the farther the unit group 10_*n* is away from the first voltage supply terminal 120 is, the larger the compensation load value of the load compensation unit 130 in the unit group 10_*n* is.

In the display panel according to the embodiments of the present disclosure, all the load compensation units are sequentially divided into at least two unit groups along a direction of the first voltage supply wire away from the first voltage supply terminal, and the farther the unit group is away from the first voltage supply terminal, the larger the compensation load value of the load compensation unit in the unit group is, so that the duration of the gate turn-on signal output from the output terminal of the gate driving circuit can be gradually reduced, thereby offsetting the brightness degradation caused by IR Drop, and improving display uniformity.

In a specific implementation, in the display panel according to the embodiments of the present disclosure, the first voltage generally refers to a high-level power supply voltage for outputting the power supply signal ELVDD.

In a specific implementation, as shown in FIG. 4*a*, the gate driving circuit generally includes cascaded shift register units SR_m, and each shift register unit SR_m corresponds to an output terminal O_m of the gate driving circuit, which is configured to electrically connect with a corresponding gate line G_m.

Generally, the gate lines have RC load, and since the process preparation conditions are generally the same, the RC load of each gate line in the display panel is substantially the same. In a specific implementation, in the embodiments of the present disclosure, the load compensation unit performs load compensation on the signal output by the output terminal O_m by actually compensating the RC load of the gate line, to improve the RC load of the gate line, thereby reducing the duration of the gate turn-on signal.

Further, the output terminal of the gate driving circuit may be electrically connected to one load compensation unit, or the output terminal of the gate driving circuit may be electrically connected to two load compensation units, three load compensation units, . . . or more load compensation units, which is designed and determined according to practical application environment, and is not limited herein.

Generally, the shape of the display panel may be a rectangle having four sides: an upper side, a lower side, a left side, and a right side. In a specific implementation, as shown in FIG. 4*a*, the gate driving circuit is disposed on the left side and/or the right side. The first voltage supply terminal 120 is disposed on the upper side and/or the lower side, so that the side where the gate driving circuit is located is adjacent to the side where the first voltage supply terminal 120 is located. Besides, the display panel further includes a plurality of pixel units PX in the display area AA, and one gate line corresponds to one row of pixel units. The gate driving circuit and the load compensation unit may be disposed in the non-display area.

Generally, the display panel can be driven in a unilateral driving or bilateral driving manner. As shown in FIG. 4*a*, each shift register unit SR_m is disposed at a same end of the corresponding gate line G_m, so that the unilateral driving can be realized. Alternatively, shift register unit may include left shift register units and right shift register units, wherein the left shift register units and the right shift register units are respectively connected to two ends of the gate lines, so that the bilateral driving can be realized.

Organic light emitting diodes (OLED) and quantum dot light emitting diodes (QLED) have the advantages of low energy consumption, low production cost, self-illumination, wide angle of view and fast response speed. In the specific implementation, the display panel may include an OLED display panel or a QLED display panel, which is not limited herein.

The following describes the present disclosure in detail with reference to specific embodiments. It should be noted that the embodiments of the present disclosure are intended to better explain the present disclosure, but do not limit the present disclosure.

Embodiment 1

Figure 4B:
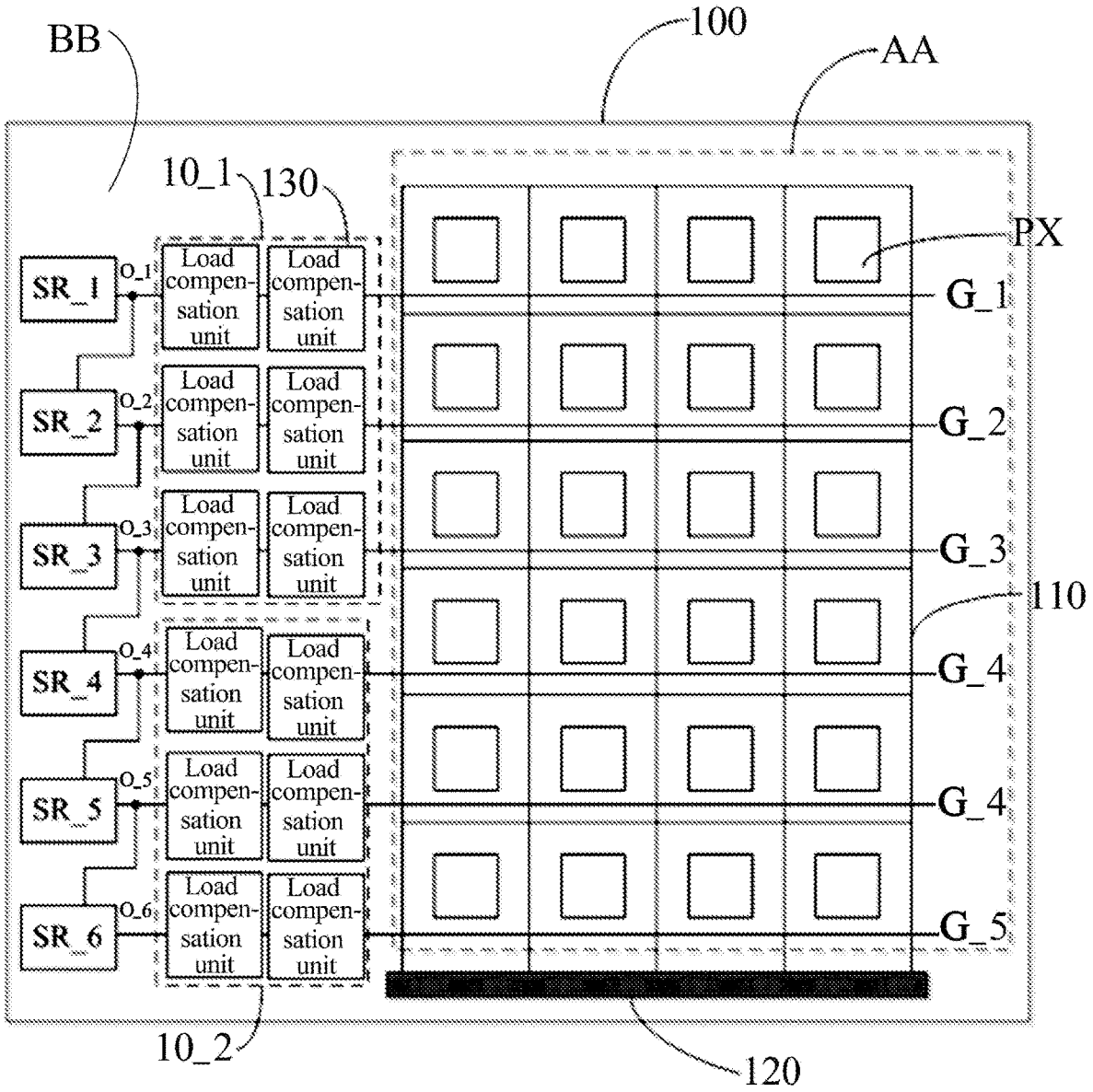
FIG. 4*b* is a second schematic structural diagram of a display panel according to an embodiment of the present disclosure.

In the specific implementation, in the embodiments of the present disclosure, as shown in FIG. 4*a*, each of the output terminals O_m of the gate driving circuit may respectively correspond to one load compensation unit 130. Therefore, the load of each of the output terminals O_m can be compensated to further improve brightness uniformity. Alternatively, as shown in FIG. 4*b*, each of the output terminals O_m of the gate driving circuit may correspond to a plurality of load compensation units 130, and the plurality of load compensation units 130 may be connected in series or in parallel. For example, each output terminal O_m may correspond to two load compensation units 130. Alternatively, each output terminal O_m may correspond to three, four, . . . or more load compensation units. This can be designed and determined according to the actual application environment, and is not limited herein.

Generally, in practical applications, the area of the display panel closer to the first voltage supply terminal 120 may be less affected by the IR Drop, and therefore, the effect may be neglected. In the specific implementation, in the embodiments of the present disclosure, only some of the output terminals of the gate driving circuit are provided with one-to-one corresponding load compensation units. The some of the output terminals may include an output terminal away from the first voltage supply terminal and at least one output terminal adjacent to the output terminal away from the first voltage supply terminal, that is, may include output terminals corresponding to the first stage shift register unit to the $K^{th}$ stage shift register unit, wherein K<M and is an integer. This reduces the arrangement of the load compensation units and reduces power consumption.

Figure 5:
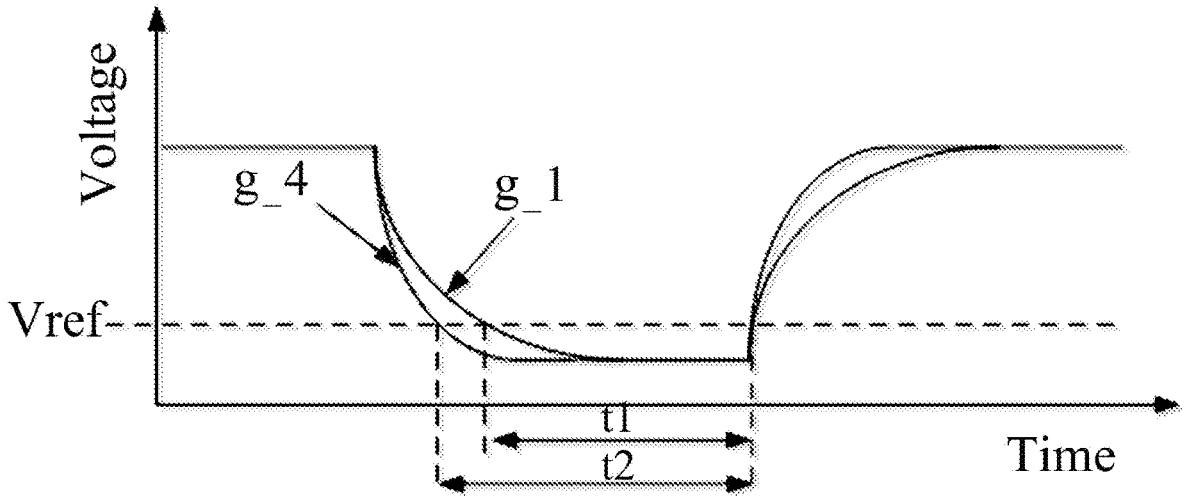
FIG. 5 is a schematic diagram of a gate turn-on signal according to an embodiment of the present disclosure.

In the specific implementation, as shown in FIG. 4*a*, the compensation load values of the load compensation units 130 in the same unit group 10_*n* are the same, and the compensation load values in different unit groups are different. As shown in FIG. 4*a*, the compensation load value in the unit group 10_2 is greater than the compensation load value in the unit group 10_1, and the gate turn-on signals output by the first stage shift register unit and the fourth stage shift register unit are taken as an example for description. The signal g_1 output by the first stage shift register unit and the signal g_4 output by the fourth stage shift register unit are shown in FIG. 5, wherein the horizontal coordinate represents time and the vertical coordinate represents voltage. Under the influence of output load, the waveforms of the signals g_1 and g_4 may vary. When voltages of the signals g_1 and g_4 fall to $V_{ref}$, the switching transistor in the pixel circuit is turned on, and the voltage $V_{data}$ of the data signal starts to be written; and when voltages of the signals g_1 and g_4 rise to $V_{ref}$, the switching transistor in the pixel circuit is loaded, and the voltage $V_{data}$ of the data signal ends the writing, namely, an equivalent writing time of the data voltage (ie, the equivalent charging time) is the time period during which the voltage is less than $V_{ref}$. Since the compensation load value in the unit group 10_1 is smaller than the compensation load value in the unit group 10_2, the charging time t2 of the signal g_4 is greater than the charging time t1 of the signal g_1; and since the equivalent charging time is less, the $V_{data}$ writing is more insufficient, so that the voltage charged to the gate of the driving transistor DTFT is reduced. Therefore, the compensation load values in the unit group 101 and the unit group 10_2 are set according to $\Delta V_{dd}$ corresponding to the unit group 10_1 and the unit group 10_2 respectively, so that $\Delta V_{data}$ corresponding to the pixel units corresponding to the unit group 10_1 and the unit group 10_2 can be consistent with the corresponding $\Delta V_{dd}$, thereby making the corresponding $\Delta V_{data}$ and the corresponding $\Delta V_{dd}$ of the same pixel unit offset with each other, to maintain the stability of I, which in turn improves the brightness uniformity of the display panel and improves the display effect.

Generally, the change of the IR drop in the area where adjacent rows of pixel units are located is relatively small, so that it can be regarded as the same. In the specific implementation, in the embodiments of the present disclosure, each unit group may include at least two adjacent load compensation units. Specifically, the unit group may include two adjacent load compensation units, that is, the compensation load values of the two rows of gate lines are the same. Alternatively, as shown in FIG. 4*a*, the unit group may also include three adjacent load compensation units 130, that is, the compensation load values of the three rows of gate lines are the same. Alternatively, the unit group may also include four, five, six, . . . or more adjacent load compensation units. The other situation is deduced by analogy and is not described herein. Certainly, each unit group may also include one load compensation unit. In actual applications, the quantity of load compensation units included in the unit group can be designed and determined according to the actual application environment, which is not limited herein.

In a specific implementation, in the embodiments of the present disclosure, as shown in FIG. 4*a*, the quantity of load compensation units 130 in each unit group 130_*n* is the same. In this way, it can make the brightness change evenly and simplify the process.

Figure 6:
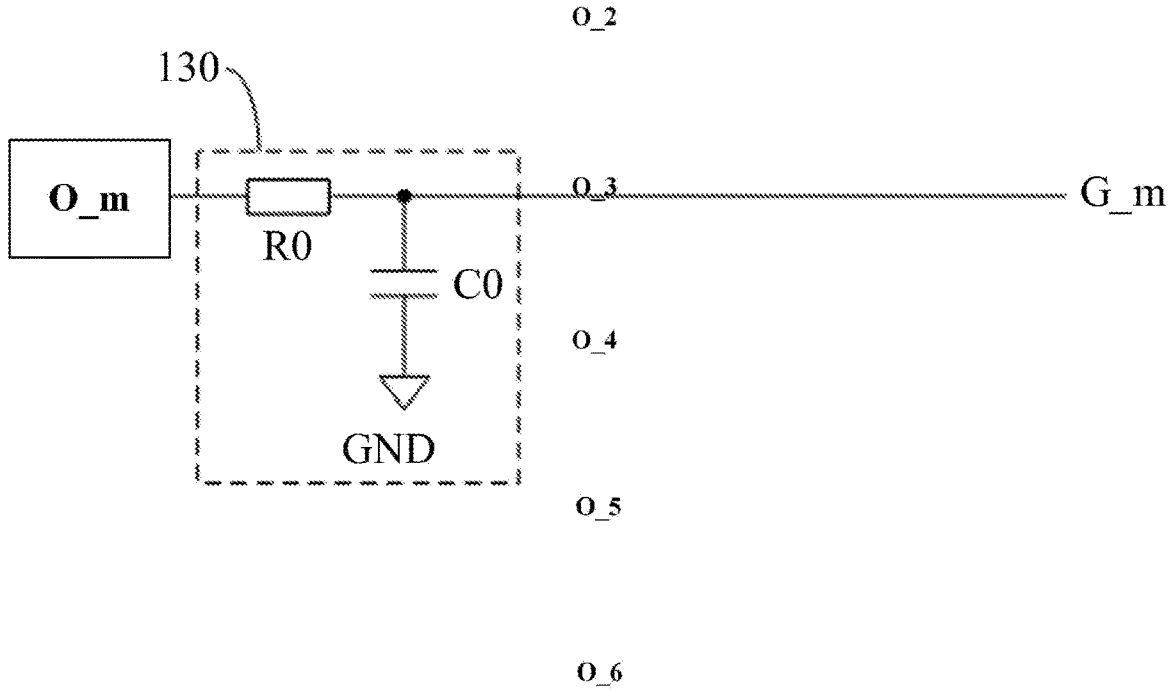
FIG. 6 is a first schematic diagram of a local structure of a display panel according to an embodiment of the present disclosure.

In a specific implementation, as shown in FIG. 6, the load compensation units 130 may include: a compensation resistor R0 and a compensation capacitor C0. The output terminal O_m of the gate driving circuit is electrically connected to the corresponding gate line G_m through the compensation resistor R0; and one terminal of the compensation capacitor C0 is electrically connected to the output terminal O_m of the gate driving circuit and the other terminal of the compensation capacitor C0 is electrically connected to a ground terminal GND. In addition, a product of a resistance value $r_0$ of the compensation resistor R0 and a capacitance value $c_0$ of the compensation capacitor C0, that is, $r_0*c_0$ acts as the compensation load value of the load compensation unit 130. Further, the specific values of $r_0$, $c_0$ and $r_0*c_0$ need to be designed and determined according to $\Delta V_{dd}$, which is not limited herein.

Figure 7:
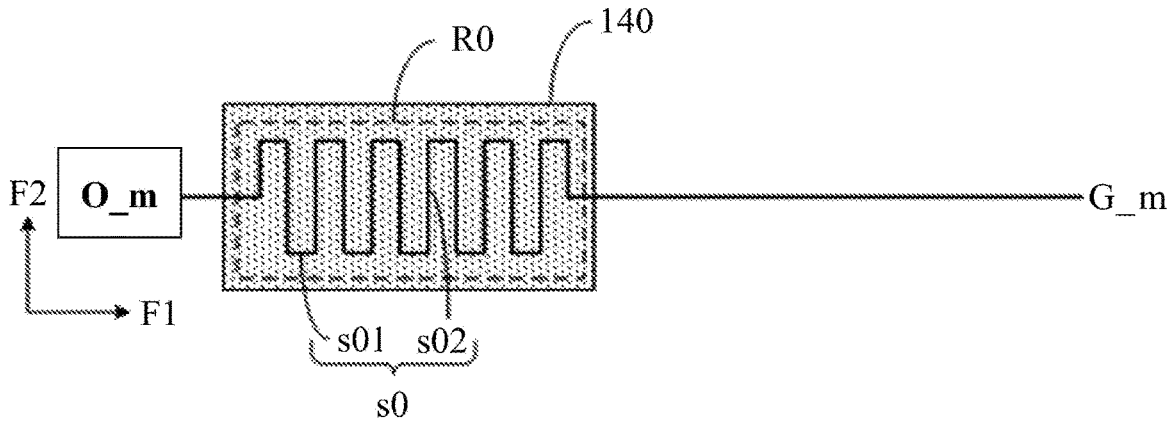
FIG. 7 is a second schematic diagram of a local structure of a display panel according to an embodiment of the present disclosure.

In a specific implementation, in the embodiments of the present disclosure, as shown in FIG. 7, the compensation resistor R0 may include: a resistor wire s0 with folding line-shape, wherein one end of the resistor wire s0 is electrically connected to the output terminal O_m of the gate driving circuit, and the other end is electrically connected to the gate line G_m. Therefore, based on a formula of resistance law: $R=\rho L/S$, wherein $\rho$ represents the resistivity, L represents the length of the resistor wire, S represents a cross-sectional area of the resistor wire, and R represents the resistance value of the resistor wire, it can be known that, R can be increased by increasing L, thereby increasing the load at the output terminal of the gate driving circuit.

Further, in a specific implementation, in the embodiments of the present disclosure, as shown in FIG. 7, the resistor wire s0 may include: a plurality of first resistor wires s01 extending in a first direction F1 and a plurality of second resistor wires s02 extending in a second direction F2, and the first resistor wires s01 are successively electrically connected to the second resistor wires s02; and the first direction F1 intersects with the second direction F2. Specifically, the first direction F1 may be perpendicular to the second direction F2; where the first direction F1 may be the row direction of the pixel units, and the second direction F2 may be the column direction of the pixel units. Alternatively, the first direction F1 may be the column direction of the pixel units, the second direction F2 is the row direction of the pixel units, which is not limited herein.

Further, in a specific implementation, in the embodiments of the present disclosure, as shown in FIG. 7, the length of the first resistor wires s01 may be the same. Certainly, the length of the at least two first resistor wires may be different, which is not limited herein.

Further, in a specific implementation, in the embodiments of the present disclosure, as shown in FIG. 7, the length of the second resistor wires s02 may be the same. Certainly, the length of the at least two second resistor wires may be different, which is not limited herein.

Further, in a specific implementation, in the embodiments of the present disclosure, as shown in FIG. 7, the cross-sectional areas of the first resistor wires s01 and the second resistor wires s02 may be the same.

Figure 8:
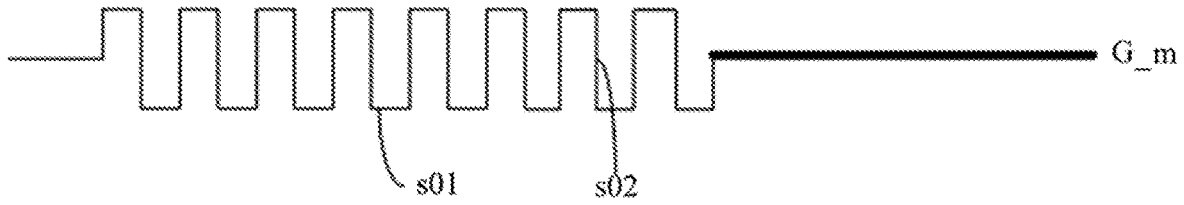
FIG. 8 is a third schematic diagram of a local structure of a display panel according to an embodiment of the present disclosure.

Further, in a specific implementation, in the embodiments of the present disclosure, as shown in FIG. 8, a cross-sectional area of at least one first resistor wire s01 is smaller than a cross-sectional area of the gate line G_m, to improve the resistance value of the compensation resistor. Since the resistance value of the compensation resistor connected to one gate line is determined, the resistance value can be reduced by reducing the cross-sectional area of the first resistor wire, and the length of the first resistor wire can be correspondingly reduced, thereby reducing occupation space. Specifically, the cross-sectional area of one first resistor wire s01 may be smaller than the cross-sectional area of the gate line G_m; or the cross-sectional areas of two first resistor wires s01 may be smaller than the cross-sectional area of the gate line G_m; or as shown in FIG. 8, the cross-sectional area of each first resistor wire s01 may be smaller than the cross-sectional area of the gate line G_m. The other situation is deduced by analogy and is not described herein.

Further, in a specific implementation, in the embodiments of the present disclosure, as shown in FIG. 8, a cross-sectional area of at least one second resistor wire s02 is smaller than a cross-sectional area of the gate line G_m, to improve the resistance value of the compensation resistor. Since the resistance value of the compensation resistor connected to one gate line is determined, the resistance value can be reduced by reducing the cross-sectional area of the second resistor wire, and the length of the second resistor wire can be correspondingly reduced, thereby reducing occupation space. Specifically, the cross-sectional area of one second resistor wire s02 may be smaller than the cross-sectional area of the gate line G_m; or the cross-sectional areas of two second resistor wires s02 may be smaller than the cross-sectional area of the gate line G_m; or as shown in FIG. 8, the cross-sectional area of each second resistor wire s02 may be smaller than the cross-sectional area of the gate line G_m. The other situation is deduced by analogy and is not described herein.

Further, in a specific implementation, in the embodiments of the present disclosure, as shown in FIG. 7, the display panel further include: a first conductive layer 140 corresponding to each resistor wire s0 and disposed in a different-layer and insulated from the resistor wire s0, wherein an orthographic projection of the first conductive layer 140 on the display panel has an overlap region with an orthographic projection of the corresponding resistor wire s0 on the display panel. Since there is an overlap area between the first conductive layer 140 and the resistor wire s0 in the overlap region, a capacitance can be formed, and thus the compensation capacitor may include: a first capacitor formed by the first conductive layer 140 and the resistor wire s0 in the overlap region. Further, the first conductive layer 140 can be electrically connected to the ground terminal. Alternatively, the first conductive layer 140 may be float, which is not limited herein. And, an insulating layer is disposed between the first conductive layer and each resistor wire.

In a specific implementation, in the embodiments of the present disclosure, as shown in FIG. 7, the orthographic projection of the first conductive layer 140 on the display panel covers the orthographic projection of the corresponding resistor wire s0 on the display panel.

Figure 9A:
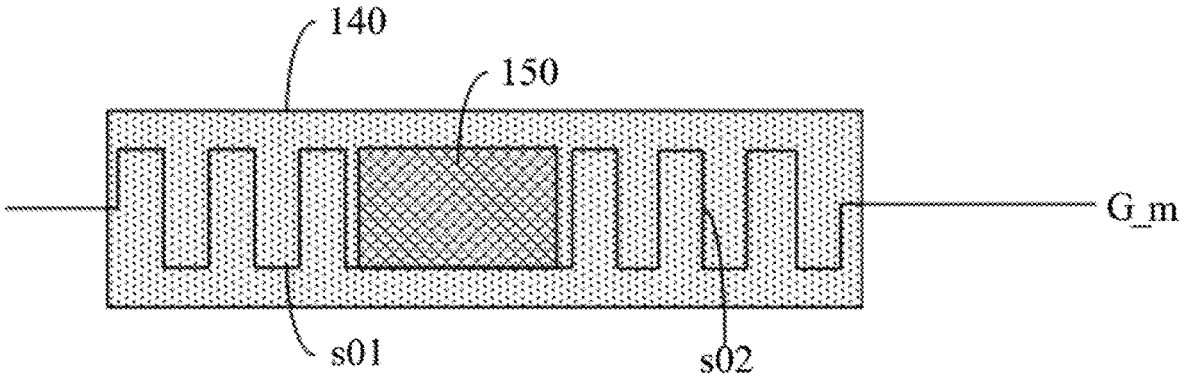
FIG. 9*a* is a fourth schematic diagram of a local structure of a display panel according to an embodiment of the present disclosure.
Figure 9B:
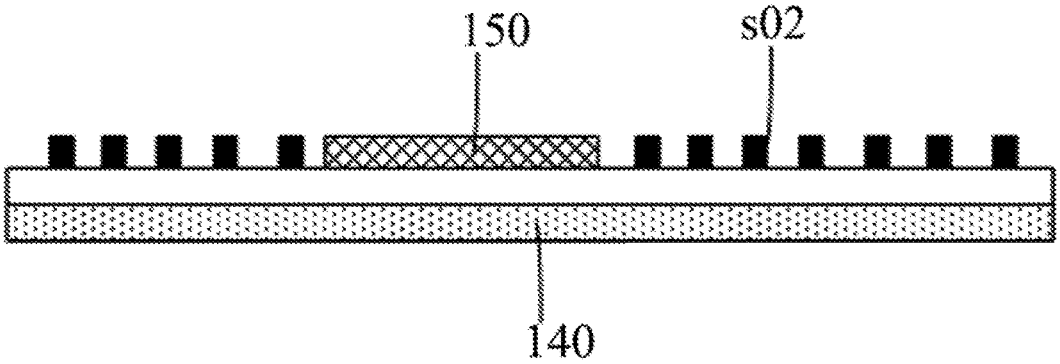
FIG. 9*b* is a cross-sectional structural view in a BB' direction of FIG. 9*a;*

In a specific implementation, in the embodiments of the present disclosure, as shown in FIG. 9*a* and FIG. 9*b*, the display panel may further include: a second conductive layer 150 connected between the first resistor wire s01 and the second resistor wire s02, wherein the orthographic projection of the first conductive layer 140 on the display panel covers an orthographic projection of the second conductive layer 150 on the display panel. Since there is an overlap area between the first conductive layer 140 and the second conductive layer 150, a capacitance can be formed, and thus the compensation capacitor may further include: a second capacitor formed by the first conductive layer 140 and the second conductive layer 150.

Further, in a specific implementation, in the embodiments of the present disclosure, the resistor wire, the second conductive layer, and the gate line can be in the same layer and can be made of same materials. In this way, the patterns of the resistor wires, the second conductive layer, and the gate lines can be formed by one patterning process, which can simplify the preparation process, save production cost, and improve production efficiency.

Further, in a specific implementation, in the embodiments of the present disclosure, the display panel may further include: a plurality of data lines. Further each first conductive layer may be insulated from the data lines and be made of the same materials and in a same layer as the data lines. In this way, the patterns of the first conductive layer and data lines can be formed by one patterning process, which can simplify the preparation process, save production cost, and improve production efficiency.

Embodiment 2

In a specific implementation, as shown in FIG. 6, the load compensation unit 130 may include: a compensation resistor R0, wherein the output terminal O_m of the gate driving circuit is electrically connected to the corresponding gate line G_m through the compensation resistor 130. And the resistance value $r_0$ of the compensation resistor acts as the compensation load value of the load compensation unit. For the specific implementation, reference may be made to the implementation of the compensation resistor R0 in Embodiment 1, and details are not described herein.

Embodiment 3

Figure 10:
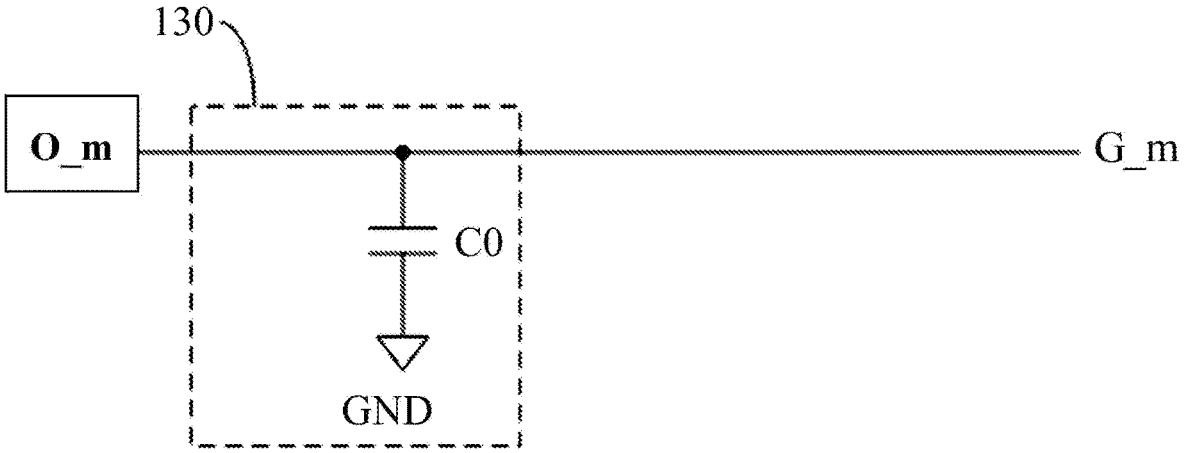
FIG. 10 is a fifth schematic diagram of a local structure of a display panel according to an embodiment of the present disclosure.

In a specific implementation, in the embodiments of the present disclosure, as shown in FIG. 10, the load compensation unit 130 may include: a compensation capacitor C0, wherein one terminal of the compensation capacitor C0 is electrically connected to the output terminal O_m of the gate driving circuit, and the other terminal is electrically connected to the ground terminal GND. And the resistance value $c_0$ of the compensation capacitor C0 can act as the compensation load value of the load compensation unit 130.

Figure 11:
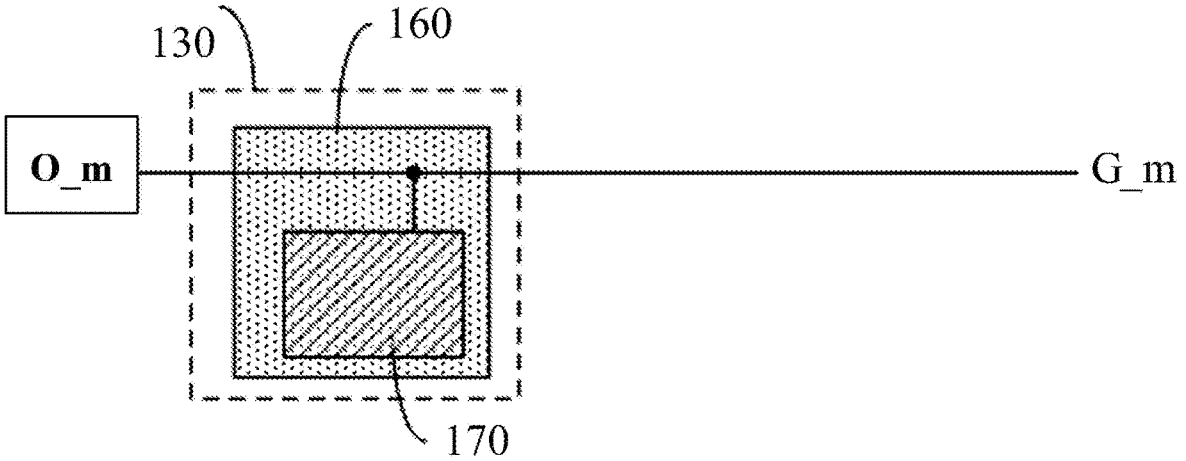
FIG. 11 is a sixth schematic diagram of a local structure of a display panel according to an embodiment of the present disclosure.

In a specific implementation, in the embodiments of the present disclosure, as shown in FIG. 11, the display panel may further include: a third conductive layer 160 corresponding to the output terminal O_m that is provided with the load compensation unit 130; and a fourth conductive layer 170 electrically connected to the output terminal O_m of the gate driving circuit that is provided with the load compensation unit 130. The third conductive layer 160 and the fourth conductive layer 170 are arranged in a different layer and insulated from each other, an orthographic projection of the third conductive layer 160 on the display panel has an overlap region with an orthographic projection of the fourth conductive layer 170 on the display panel, and the compensation capacitor may include: a third capacitor formed by the third conductive layer 160 and the fourth conductive layer 170 in the overlap region. The third conductive layer may be electrically connected to the ground terminal. Alternatively, the third conductive layer may be float, which is not limited herein.

In a specific implementation, in the embodiments of the present disclosure, as shown in FIG. 11, the orthographic projection of the third conductive layer 160 on the display panel covers the orthographic projection of the fourth conductive layer 170 on the display panel.

Based on the same inventive concept, the embodiments of the present disclosure further provide a display device, including the display panel according to the embodiments of the present disclosure. The principle of the display device for solving problems is similar to that of the foregoing display panel. Therefore, the implementation of the display device can be referred to the implementation of the foregoing display panel, and the description is not repeated herein again.

In the specific implementation, the display device according to the embodiments of the present disclosure may be any product or component having a display function, such as a mobile phone, a tablet computer, a television, a display, a notebook computer, a digital photo frame, a navigator, and the like. Those skilled in the art should understand that the display device includes other indispensable components, which are not described herein, nor should they be construed as a limitation on this disclosure.

In the display panel and the display device according to the embodiments of the present disclosure, at least one load compensation unit is arranged in the non-display area, the at least one load compensation unit can be configured to adjust the charging time of pixels by controlling the gate lines, thereby making brightness of each area of the display screen uniform.

Apparently, those skilled in the art may make various modifications and variations to the present disclosure without departing from the spirit and scope of the present disclosure. Therefore, the present disclosure shall be construed to include these modifications and variations, provided that these modifications and variations fall within the scope of the claims and equivalent technologies of the present disclosure.

The invention claimed is:

1. A display panel, comprising:

a plurality of gate lines;

a plurality of data lines intersecting with the gate lines;

a plurality of pixel units defined by the gate lines and data lines, each pixel unit comprising a pixel circuit;

a plurality of voltage supply wires intersecting with the gate lines, each voltage supply wire electrically connected with the pixel circuit;

a voltage supply terminal electrically connected to the voltage supply wires;

a gate driving circuit, wherein the gate driving circuit comprises a plurality of output terminals, and at least one of the plurality of output terminals is electrically connected to at least one of the plurality of gate lines; and at least one load compensation unit, between the at least one output terminal and the at least one gate line, and electrically connected with the at least one gate line and the at least one output terminal;

wherein the display panel comprises a display area and a non-display area surrounding the display area, the plurality of gate lines, the plurality of data lines, and the voltage supply wires are in the display area, and the gate driving circuit, the at least one load compensation unit, and the voltage supply terminal are in the non-display area;

in a direction from the voltage supply terminal to the voltage supply wires, the farther a load compensation unit is away from the voltage supply terminal, the larger compensation load value of the load compensation unit is; and the at least one load compensation unit is configured to adjust charging time of pixels by controlling the gate lines, to make brightness of a plurality of areas of a display screen uniform.

2. The display panel according to claim 1, wherein each of the output terminals of the gate driving circuit is respectively connected to one of the plurality of gate lines, and different output terminals are connected to different gate lines.

3. The display panel according to claim 2, wherein all the load compensation units are sequentially divided into at least two unit groups along a direction of the voltage supply wires away from the voltage supply terminal, and each of the unit groups includes at least one load compensation unit; and the farther the unit group is away from the voltage supply terminal, the larger compensation load value of the load compensation unit in the unit group is.

4. The display panel according to claim 3, wherein the unit group comprises at least two adjacent load compensation units.

5. The display panel according to claim 4, wherein compensation load values of the load compensation units in a same unit group are the same, and the compensation load values in different unit groups are different.

6. The display panel according to claim 3, wherein a quantity of the load compensation units in each unit group is the same.

7. The display panel according to claim 1, wherein the load compensation unit comprises at least one of a compensation resistor and a compensation capacitor; the output terminal of the gate driving circuit is electrically connected to the corresponding gate line through the compensation resistor; and one terminal of the compensation capacitor is electrically connected to the output terminal of the gate driving circuit and the other terminal of the compensation capacitor is electrically connected to a ground terminal;

when the load compensation unit comprises the compensation resistor, a resistance value of the compensation resistor acts as a compensation load value of the load compensation unit;

when the load compensation unit comprises the compensation capacitor, a capacitance value of the compensation capacitor acts as the compensation load value of the load compensation unit; and when the load compensation unit comprises the compensation resistor and the compensation capacitor, a product of the resistance value of the compensation resistor and the capacitance value of the compensation capacitor acts as the compensation load value of the load compensation unit.

8. The display panel according to claim 7, wherein the compensation resistor comprises: a resistor wire with folding line-shape; wherein one end of the resistor wire is electrically connected to the output terminal of the gate driving circuit, and the other end of the resistor wire is electrically connected to the gate line.

9. The display panel according to claim 8, wherein the resistor wire comprises: a plurality of first resistor wires extending in a first direction and a plurality of second resistor wires extending in a second direction, and the first resistor wires are successively electrically connected to the second resistor wires; and the first direction intersects with the second direction.

10. The display panel according to claim 9, wherein a cross-sectional area of at least one of the first resistor wires and the second resistor wires is smaller than a cross-sectional area of the gate line.

11. The display panel according to claim 8, further comprising: a first conductive layer corresponding to each of the resistor wires and disposed in a different-layer and insulated from the resistor wire; wherein an orthographic projection of the first conductive layer on the display panel has an overlap region with an orthographic projection of the corresponding resistor wire on the display panel; and the compensation capacitor comprises: a first capacitor between the first conductive layer and the resistor wire in the overlap region.

12. The display panel according to claim 11, wherein the orthographic projection of the first conductive layer on the display panel covers the orthographic projection of the corresponding resistor wire on the display panel.

13. The display panel according to claim 11, further comprising: a second conductive layer connected between the first resistor wires and the second resistor wires; wherein the orthographic projection of the first conductive layer on the display panel covers an orthographic projection of the second conductive layer on the display panel; and the compensation capacitor further comprises: a second capacitor between the first conductive layer and the second conductive layer.

14. The display panel according to claim 7, further comprising: a third conductive layer corresponding to the output terminal, and a fourth conductive layer electrically connected to the output terminal, the output terminal is provided with the load compensation unit; wherein the third conductive layer and the fourth conductive layer are in a different-layer and insulated from each other;

an orthographic projection of the third conductive layer on the display panel has an overlap region with an orthographic projection of the fourth conductive layer on the display panel; and the compensation capacitor comprises: a third capacitor between the fourth conductive layer and the third conductive layer in the overlap region.

15. The display panel according to claim 14, wherein the orthographic projection of the third conductive layer on the display panel covers the orthographic projection of the fourth conductive layer on the display panel.

16. A display device, comprising the display panel according to claim 1.

* * * * *